US010602770B2

(12) United States Patent
Camus

(10) Patent No.: US 10,602,770 B2
(45) Date of Patent: Mar. 31, 2020

(54) SMOKING ARTICLE WITH TRANSPARENT WRAPPER

(71) Applicant: PHILIP MORRIS PRODUCTS S.A., Neuchatel (CH)

(72) Inventor: Alexandre Camus, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 769 days.

(21) Appl. No.: 14/648,370

(22) PCT Filed: Dec. 3, 2013

(86) PCT No.: PCT/EP2013/075434
§ 371 (c)(1),
(2) Date: May 29, 2015

(87) PCT Pub. No.: WO2014/086802
PCT Pub. Date: Jun. 12, 2014

(65) Prior Publication Data

US 2015/0296875 A1 Oct. 22, 2015

(30) Foreign Application Priority Data

Dec. 4, 2012 (EP) ..... 12195567

(51) Int. Cl.
*A24D 1/02* (2006.01)
*A24D 3/04* (2006.01)
*A24D 1/04* (2006.01)

(52) U.S. Cl.
CPC ..... *A24D 1/02* (2013.01); *A24D 1/042* (2013.01); *A24D 3/04* (2013.01)

(58) Field of Classification Search
None
See application file for complete search history.

(56) References Cited

U.S. PATENT DOCUMENTS 7,789,089 B2 9/2010 Dube
8,256,434 B2 9/2012 Watters
(Continued)

FOREIGN PATENT DOCUMENTS

CN 102458162 A 5/2012
CN 102469834 5/2012
(Continued)

OTHER PUBLICATIONS

European Search Report for Application No. 12195567.8 dated Aug. 1, 2013 (6 pages).
(Continued)

*Primary Examiner* — Joseph S Del Sole
*Assistant Examiner* — Manley L Cummins, IV
(74) *Attorney, Agent, or Firm* — Mueting, Raasch & Gebhardt, P.A.

(57) ABSTRACT

A method of manufacturing a smoking article (10) comprises providing a mouthpiece (14) and an aerosol generating substrate (12) in axial alignment with the mouthpiece (14). The mouthpiece (14) includes one or more segments (16) and a substantially transparent wrapper (18) circumscribing at least a portion of the one or more segments (16). A sheet of paper material is provided and comprises a window in the paper material. The ratio of shrinkage of the substantially transparent wrapper (18) to shrinkage of the paper material at the time of manufacture of the smoking article is less than 3.5 when subjected to 15 percent relative humidity at 42 degrees Celsius for 3 hours. The sheet of paper material is wrapped around at least a portion of the transparent wrapper (18) so that an underlying mouthpiece segment can be viewed through the window and the substantially transparent wrapper (18).

11 Claims, 2 Drawing Sheets

(56) References Cited

U.S. PATENT DOCUMENTS

| | | | | |
|---|---|---|---|---|
| 8,360,074 | B2 | 1/2013 | Sutton | |
| 9,723,868 | B2 | 8/2017 | Griesmayr | |
| 2010/0108084 | A1 | 5/2010 | Norman | |
| 2011/0100386 | A1 | 5/2011 | Watters | |
| 2012/0085359 | A1 * | 4/2012 | Sutton | A24C 5/471 131/280 |
| 2012/0240948 | A1 * | 9/2012 | Griesmayr | A24D 1/02 131/229 |

FOREIGN PATENT DOCUMENTS

| | | | |
|---|---|---|---|
| CN | 102711531 | A | 10/2013 |
| EP | 2462820 | | 6/2012 |
| EP | 2583570 | | 4/2013 |
| JP | S35-17590 | | 11/1960 |
| JP | H07-040433 | | 2/1995 |
| JP | H10-034845 | | 2/1998 |
| JP | H11-006794 | | 1/1999 |
| JP | 2002335975 | | 11/2002 |
| JP | 2008-087182 | | 4/2008 |
| JP | 2009-545324 | | 12/2009 |
| JP | 2012-529276 | | 11/2012 |
| RU | 64029 | | 6/2007 |
| WO | WO 2004/068975 | | 8/2004 |
| WO | WO 2009106374 | * | 9/2009 |
| WO | WO 2009/147122 | | 12/2009 |
| WO | WO 2011/080007 | | 7/2011 |
| WO | WO 2012/076649 | | 6/2012 |
| WO | WO 2012/156694 | | 11/2012 |
| WO | WO 2013057282 | A1 * | 4/2013 |
| WO | WO 2013/068100 | | 5/2013 |

OTHER PUBLICATIONS

PCT Search Report and Written Opinion for PCT/EP2013/075434 dated Jan. 8, 2015 (16 pages).
Das Papier, 16 Jahrgang, Heft Jan. 1, 1962 pp. 9-18, 28 pages. English translation included.
Physics Education (Japanese journal), 36(3) , 208-211, Sep. 10, 1988, 13 pages. English translation included.
Polymer Chemistry (Japanese journal), vol. 17, No. 184 (1960), 15 pages. English translation included.
Polymer (Japanese journal), vol. 13 (1964) No. 2, p. 100-107, 28 pages. English translation included.
Polymer (Japanese journal), vol. 15 (1966) No. 8, p. 654-659, 19 pages. English translation included.
Catalog 'Taiko Cellophane (Futamura Chemical Co., Ltd.), 12 pages. English translation included.
Office Action issued in Japan for Application No. 2015-545790 dated Aug. 7, 2017 (9 pages). English translation included.
Office Action issued in Japan for application No. 2015-545790 dated Jun. 20, 2018 (English translation included).
Office Action issued in Taiwan for Application No. 102144327 dated Apr. 24, 2018 (20 pages). English translation included.
Office Action issued in Russia for Application No. 2015126793 dated May 8, 2018 (11 pages). English translation included.
Office Action issued in China for Application No. 201380063088.5 dated Mar. 20, 2018 (15 pages). English translation included.
Office Action issued in Japan for Application No. 2018-198430 dated Feb. 3, 2020 (4 pages). English translation included.

* cited by examiner

SMOKING ARTICLE WITH TRANSPARENT WRAPPER

This application is a U.S. National Stage Application of International Application No. PCT/EP2013/075434, filed Dec. 3, 2013, which was published in English on Jun. 12, 2014 as International Patent Publication WO 2014/086802 A1. International Application No. PCT/EP2013/075434 claims priority to European Application No. 12195567.8 filed Dec. 4, 2012.

The present invention relates to a smoking article having a substantially transparent wrapper and a paper wrapper, and a method of manufacturing such smoking articles. The present invention also relates to the use of such wrappers in smoking articles.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper, normally formed of an opaque paper material that circumscribes the entire length of the filter and an adjacent portion of the wrapped tobacco rod.

A number of smoking articles in which an aerosol generating substrate, such as tobacco, is heated rather than combusted have also been proposed in the art. In heated smoking articles, the aerosol is generated by heating the aerosol generating substrate. Known heated smoking articles include, for example, smoking articles in which an aerosol is generated by electrical heating or by the transfer of heat from a combustible fuel element or heat source to an aerosol generating substrate. During smoking, volatile compounds are released from the aerosol generating substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

It has previously been proposed to provide smoking articles having a wrapper which is at least partially transparent such that a consumer can observe at least a portion of the smoking article through the wrapper. For example, smoking articles have been provided with tipping wrappers formed from a transparent polymeric material. However, a transparent polymeric tipping wrapper provides a different surface feel compared to traditional paper tipping wrappers, which tends to be disliked by consumers.

As an alternative, it has also been proposed to provide smoking articles having an opaque tipping paper with a cut-out window so that a consumer can observe an underlying portion of the smoking article through the cut-out window. Where a plug wrap is provided between such tipping paper and the underlying filter, it has been necessary to use a plug wrap formed from a transparent material so that a user can see the underlying portion of the smoking article through the window and through the transparent plug wrap. However, the present inventors have found that the combination of a traditional paper tipping wrapper and a transparent polymeric plug wrap can lead to undesirable wrinkling of the paper tipping wrapper after manufacture of the smoking articles.

It would therefore be desirable to provide a smoking article having a substantially transparent wrapper and a paper wrapper such that wrinkling of the paper wrapper after manufacture of the smoking articles is reduced or prevented.

Accordingly, the present invention provides a method of manufacturing a smoking article, the method comprising providing a mouthpiece and an aerosol generating substrate in axial alignment with the mouthpiece. The mouthpiece includes one or more segments and a substantially transparent wrapper circumscribing at least a portion of the one or more segments. A sheet of paper material is provided and comprises a window in the paper material. The ratio of shrinkage of the substantially transparent wrapper to shrinkage of the paper material at the time of manufacture of the smoking article is less than about 3.5 when subjected to 15 percent relative humidity at 42 degrees Celsius for 3 hours. The sheet of paper material is wrapped around at least a portion of the substantially transparent wrapper so that an underlying mouthpiece segment can be viewed through the window and the substantially transparent wrapper.

In some embodiments, the sheet of paper material is wrapped around a portion of the aerosol generating substrate and secures the mouthpiece to the aerosol generating substrate to form all or a portion of the smoking article.

The ratio of shrinkage is preferably less than about 3, more preferably less than about 2.5, even more preferably less than about 2, even more preferably less than about 1.5, even more preferably less than about 1. In some embodiments, the ratio of shrinkage is around 1.

The present invention also extends to smoking articles manufactured using the above method. Such smoking articles comprise a mouthpiece having one or more segments and a substantially transparent wrapper circumscribing at least a portion of the one or more segments. The smoking article also includes an aerosol generating substrate in axial alignment with the mouthpiece and a paper wrapper circumscribing at least a portion of the mouthpiece and a portion of the aerosol generating substrate to secure the mouthpiece to the aerosol generating substrate. The smoking article also comprises a window in the paper wrapper so that an underlying mouthpiece segment can be viewed through the window and the substantially transparent wrapper. The ratio of shrinkage of the substantially transparent wrapper to shrinkage of the paper wrapper at the time of manufacture of the smoking article is less than about 3.5 when subjected to 15 percent relative humidity at 42 degrees Celsius for 3 hours.

The ratio of shrinkage is preferably less than about 3, more preferably less than about 2.5, even more preferably less than about 2, even more preferably less than about 1.5, even more preferably less than about 1. In some embodiments, the ratio of shrinkage is around 1.

The following description of the invention will be made with reference to the smoking article itself, although the features described can be applied equally to the method for manufacturing the smoking articles described above.

The term "substantially transparent" is used herein to describe a material which allows at least a sufficient proportion of incident light to pass through it so that it is possible to see through the material. In the present invention, the substantially transparent wrapper allows sufficient light to pass through it such that an underlying mouthpiece segment is visible through the wrapper.

The substantially transparent wrapper may be completely transparent. Alternatively, the substantially transparent wrapper may have a lower level of transparency whilst still transmitting sufficient light so that the underlying mouthpiece segment is visible through the substantially transparent wrapper. In some cases, the substantially transparent wrapper may be tinted or coloured.

The term "at the time of manufacture of the smoking article" is used herein to describe the stage at which the components of the smoking article are assembled to form the smoking article. In many cases, this would be the stage at which the sheet of paper material is wrapped around at least a portion of the mouthpiece that is circumscribed by the substantially transparent wrapper.

The term "shrinkage" is used herein to describe the amount by which a material shrinks when exposed to 15 percent relative humidity at 42 degrees Celsius for a period of 3 hours. In some cases, shrinkage can be observed visually, particularly when relative shrinkage between a polymeric transparent plug wrap and a paper tipping wrapper causes visible wrinkling of the tipping paper, as described above. Therefore, one way to initially evaluate whether a smoking article has been manufactured according to the present invention is to observe whether the article has visible wrinkling of the tipping paper. If there is no visible wrinkling, and the smoking article includes a paper wrapper circumscribing at least a portion of a substantially transparent wrapper, this may indicate that the smoking article has been manufactured in accordance with the present invention.

In some embodiments, shrinkage can result in undesirable wrinkling which may not be noticeable visually. However, in some such cases, wrinkling may also be detected by other means. For example, wrinkling may be detected by a consumer when placing the tipping paper against their lips. To accurately determine a shrinkage value, the material should therefore be measured before and after exposure to the environmental conditions above. In particular, shrinkage is determined by measuring the longest dimension, a, of the material prior to exposure to 15 percent relative humidity at 42 degrees Celsius for a period of 3 hours and then measuring the same dimension, b, after exposure to 15 percent relative humidity at 42 degrees Celsius for a period of 3 hours. The measurements are conducted using Shrinkage Test 1, which is described in more detail below. The shrinkage of the material can then be calculated according to Equation 1 below:

$$\text{shrinkage}\ (\%) = \frac{a-b}{a} \times 100 \tag{1}$$

The present inventors have recognised that it is possible to reduce or eliminate wrinkling of the paper wrapper by minimising the relative shrinkage between the paper wrapper and the underlying substantially transparent wrapper, which are typically joined together by adhesive during manufacture of the smoking article. Smoking articles in accordance with the present invention therefore advantageously permit the use of substantially transparent wrappers with overlying wrappers formed of conventional paper materials, whilst ensuring that the paper material does not wrinkle when the smoking article has aged, for example if it is subjected to elevated temperatures and low humidity during storage of the article.

To minimise the relative shrinkage between the substantially transparent wrapper and the paper wrapper when using conventional paper materials to form the paper wrapper (for example, standard tipping paper), the substantially transparent wrapper preferably exhibits shrinkage of less than about 0.85 percent. More preferably, the substantially transparent wrapper exhibits shrinkage of less than about 0.5 percent. Even more preferably, the substantially transparent wrapper exhibits shrinkage of less than about 0.2 percent. In one embodiment, the substantially transparent wrapper exhibits shrinkage of between 0.15 percent and 0.35 percent. In one embodiment, the substantially transparent wrapper exhibits shrinkage of around 0.2 percent.

The thickness of the substantially transparent wrapper is preferably at least about 25 micrometers. More preferably, the thickness of the substantially transparent wrapper is between about 25 micrometers and about 75 micrometers. The basis weight of the substantially transparent wrapper is preferably at least about 40 grams per square meter (gsm). More preferably, the basis weight of the substantially transparent wrapper is between about 40 gsm and about 80 gsm.

The substantially transparent wrapper may be formed from a material which inherently exhibits a low shrinkage value as required to provide the ratio of shrinkage according to the present invention. Alternatively, the substantially transparent wrapper may be formed from a material which normally exhibits an undesirably high shrinkage value, but which has been subjected to a pre-treatment process. For example, a material with a normally high shrinkage value can be subjected to a pre-shrinking process prior to incorporation of the material into the smoking article. A suitable pre-shrinking process may include exposing the material to the dry conditions described above (15 percent relative humidity at 42 degrees Celsius for 3 hours). An alternative pre-treatment process may include the application of a coating to at least one surface of a material with a normally high shrinkage value. For example, a material with a normally high shrinkage value can be coated on at least one surface with a moisture barrier coating to reduce shrinkage of the material when exposed to dry conditions such as 15 percent relative humidity at 42 degrees Celsius for 3 hours. Preferably, the moisture barrier coating is applied on both surfaces of the material. The moisture barrier coating may be directly applied to one or both surfaces of the material prior to incorporating the material into a smoking article. Alternatively, the moisture barrier coating may be applied to another component of the smoking article so that the moisture barrier coating is brought into contact with the substantially transparent material when the smoking article is assembled. For example, a moisture barrier coating could be applied to the inner surface of a sheet of tipping material so that the moisture barrier coating comes into contact with the substantially transparent wrapper when the sheet of tipping material is wrapped around the substantially transparent wrapper to form the paper wrapper.

A suitable material for forming the moisture barrier coating is nitrocellulose lacquer.

The term "moisture barrier coating" is used herein to describe a coating which is substantially impermeable to water. Suitable moisture barrier coatings can be formed from materials that exhibit a degree of hydrophobicity, such as nitrocellulose lacquer as described above. One measure of the hydrophobicity of a material is the contact angle of a water droplet with the surface of the material. The contact angle is measured between a tangent to the surface of the water droplet at the point it contacts the material and the surface of the material located beneath the water droplet. That is, the contact angle extends through the water droplet, rather than through the surrounding gas, as further described and shown below.

Therefore, in those embodiments in which the substantially transparent wrapper is formed from a material comprising a moisture barrier coating, the contact angle of a water droplet with the moisture barrier coating is preferably at least about 60 degrees, more preferably at least about 70 degrees, even more preferably at least about 80 degrees, and even more preferably at least about 85 degrees. In some embodiments, the contact angle is less than 125 degrees, more preferably less than 110 degrees. Preferably, the contact angle is around 90 degrees. In one preferred embodiment, the contact angle is between 70 degrees and 110 degrees. For comparison, the contact angle of cellulose film is typically less than 30 degrees.

In accordance with another aspect, the present invention provides a smoking article comprising a mouthpiece having one or more segments and a substantially transparent wrapper circumscribing at least a portion of the one or more segments. An aerosol generating substrate is provided in axial alignment with the mouthpiece and a paper wrapper circumscribes at least a portion of the mouthpiece and a portion of the aerosol generating substrate to secure the mouthpiece to the aerosol generating substrate. A first moisture barrier coating is provided between the substantially transparent wrapper and the one or more segments, and a second moisture barrier coating is provided between the paper wrapper and the substantially transparent wrapper. The substantially transparent wrapper may be a film, such as a cellulose film or any of the other films described herein. The contact angle of a water droplet with one or both of the moisture barrier coatings is preferably at least about 80 degrees, more preferably at least about 85 degrees. In some embodiments, the contact angle is less than 150 degrees. Preferably, the contact angle is around 90 degrees. In some embodiments, one or both of the moisture barrier coatings are formed from nitrocellulose lacquer.

In any of the aspects or embodiments of the invention described above, the substantially transparent wrapper is preferably formed from a polymeric film, which can be formed from a single layer of polymeric material or a laminate composed of two or more layers. Preferably, the polymeric film comprises a cellulose based film, such as cellulose diacetate, or biaxially oriented polypropylene, both of which can be used to form a substantially transparent wrapper. The inventors have found that these materials provide favourable dimensional stability, which minimises shrinkage. Alternatively, where the substantially transparent film comprises a moisture barrier coating, the polymeric film may comprise a cellulose film having the moisture barrier coating on at least one surface thereof, preferably on both surfaces. The moisture barrier coating may be formed of nitrocellulose lacquer.

The substantially transparent wrapper may be dissolvable. That is, the substantially transparent wrapper may be capable of dissolving into a solution with a water solvent such that it no longer retains its original structure. In those embodiments in which the substantially transparent wrapper is formed from a polymeric film, this can be achieved through the use of one or more water soluble materials to form the polymeric film. The film may be made entirely of one or more water-soluble polymers or it may additionally include other polymers or inert components, such as inert inorganic fillers, which may or may not be dissolvable.

In addition to or as an alternative to being dissolvable, the substantially transparent wrapper may be biodegradable. Preferably, where the substantially transparent wrapper is a polymeric film, the film is fully biodegradable as defined in the Aqueous Aerobic Biodegradation Test (Sturm test) outlined in European standard EN13432. Preferred biodegradable polymers include starch, polyvinyl alcohol and combinations thereof.

The mouthpiece of smoking articles in accordance with the present invention may comprise a filter including one or more segments of filtration material. For example, the mouthpiece may comprise a single segment of filtration material, or the mouthpiece may comprise a multi-segment filter including two or more segments of filtration material. Where two or more filter segments are provided, the filter segments may be of the same construction and materials as each other. Preferably, however, the filter segments have a different construction, and/or contain different filtration material to each other.

In embodiments in which the mouthpiece comprises two or more segments of filtration material, at least two segments of filtration material may be spaced apart to form a cavity therebetween. The cavity may be at least partially filled with a flavourant material.

In any of the embodiments in which the mouthpiece comprises one or more segments of filtration material, at least one of the filter segments may include a flavourant material. This may be in addition to any flavourant material provided in a cavity when present.

In some embodiments, the flavourant material is particulate flavourant material. Suitable particulate flavourant materials include particles of a sorbent or cellulosic material impregnated with a liquid flavourant. In some preferred embodiments, the particulate flavourant material may comprise particles of plant leaf, as described in EP-A-1,958,523. For example, flavourant material may include leaf from tobacco, green tea, peppermint, spearmint, laurel, eucalyptus, basil, sage, verbena and tarragon. In addition, portions of mint plants may also be used. The term 'mint' refers to plants that belong to the genus *Mentha*. The plant material may alternatively be in the form of a seed, root, bark and/or flower, such as those typically used as spices.

In some embodiments, the flavourant material is provided in a capsule which is adapted to release at least a portion of a fluid when the capsule is subjected to external force, such as squeezing, by the consumer.

The mouthpiece may also include a particulate material that does not comprise a flavourant, such as beads or granules of a cellulosic material or an adsorbent. This may be in addition to or as an alternative to the particulate flavourant materials described above. Suitable adsorbents include activated carbon, carbon beads, active aluminium, zeolites, sepiolites, molecular sieves and silica gel.

Where the mouthpiece includes one or more segments of filtration material, the filtration material is preferably a plug of fibrous filtration material, such as cellulose acetate tow or paper. A filter plasticiser may be applied to the fibrous filtration material in a conventional manner, by spraying it onto the separated fibres, preferably before applying any particulate material to the filtration material. The mouthpiece may include a variety of different types of filter segments or combinations of filter segments, including those described above as well as other types of filter segments that would be known to the skilled person, such as segments including restrictors and segments that are used for adjusting the resistance to draw (RTD).

Where the filter comprises a single segment, the substantially transparent wrapper may be a plug wrap surrounding the filter material. Where the filter comprises two or more segments, any or all of the segments may each be individually wrapped in a segment plug wrap. The segments of the filter may then be subsequently attached to one another in a conventional manner using a substantially transparent wrapper, which forms a combining plug wrap. In this case, at least one of the segment plug wraps is preferably transparent in addition to the combining plug wrap being transparent, and in some cases these transparent wrappers are formed from the same material.

A window may be provided in the paper wrapper such that an underlying mouthpiece segment can be viewed through the window and the substantially transparent wrapper. This allows a consumer to view a portion of the mouthpiece underlying the substantially transparent wrapper. The paper wrapper may include a single window or multiple windows as desired. Where the paper wrapper includes multiple windows, they may be identical windows or they may have different sizes or shapes to accommodate different mouthpiece designs.

The window may be provided by forming a cut-out in the paper wrapper. Alternatively, the paper wrapper may be formed from a composite material having a band of transparent material which circumscribes at least a portion of the mouthpiece to form a window. As a further alternative, the paper wrapper can comprise two bands of paper material which are spaced apart along the length of the mouthpiece to define a gap, the gap forming the window.

In embodiments in which the paper wrapper includes a window, the window may extend around the entire circumference of the mouthpiece. However, preferably, the window extends around only a portion of the circumference of the mouthpiece. In some embodiments, the mouthpiece preferably includes a high basis weight transparent plug wrap underlying the paper wrapper and extending across the window to prevent the mouthpiece from collapsing or breaking at the window during use. For example, the basis weight of the substantially transparent plug wrap can be at least 60 gsm, preferably around 80 gsm.

In those embodiments in which the mouthpiece includes a cavity, the window preferably overlies at least a portion of the cavity so that a consumer can observe the cavity through the window and the substantially transparent layer.

Alternatively, or in addition, the paper wrapper may include a window which overlies at least a portion of a filter segment which includes a particulate material so that a consumer can observe the particulate material through the window and the substantially transparent layer. Where the paper wrapper also includes a window overlying a cavity within the mouthpiece, these may be the same window extending over both portions of the mouthpiece or they may be different windows.

In smoking articles according to the present invention, the mouthpiece may abut the aerosol-generating substrate, or the mouthpiece may not abut the aerosol-generating substrate. For example, the mouthpiece may be spaced apart from the aerosol-generating substrate so as to define a gap or a cavity therebetween. Alternatively, an intervening material may be positioned between the mouthpiece and the aerosol-generating substrate.

Smoking articles in accordance with the present invention may be filter cigarettes or other smoking articles in which tobacco material is combusted to form smoke. For example, the aerosol-generating substrate may comprise a tobacco rod and the mouthpiece may comprise a filter, as described above. The paper wrapper may comprise a tipping wrapper.

Alternatively, smoking articles according to the present invention may be articles in which an aerosol-generating substance, such as tobacco, is heated to form an aerosol rather than combusted. In one type of heated smoking article, an aerosol generating substance is heated by one or more electrical heating elements to produce an aerosol. In another type of heated smoking article, an aerosol is produced by the transfer of heat from a combustible or chemical heat source to a physically separate aerosol generating substrate, which may be located within, around or downstream of the heat source. The present invention further encompasses smoking articles in which a nicotine-containing aerosol is generated from a tobacco material, tobacco extract, or other nicotine source, without combustion, and in some cases without heating, for example through a chemical reaction.

The present invention also provides mouthpieces suitable for use in a smoking article as described above. Accordingly, in some embodiments the present invention provides a mouthpiece for a smoking article, the mouthpiece comprising one or more segments and a substantially transparent wrapper circumscribing at least a portion of the one or more segments. The shrinkage of the substantially transparent wrapper at the time of manufacture of the mouthpiece is less than 0.85 percent when subjected to 15 percent relative humidity at 42 degrees Celsius for 3 hours. Preferably, the substantially transparent wrapper exhibits shrinkage of less than about 0.5 percent. More preferably, the substantially transparent wrapper exhibits shrinkage of less than about 0.2 percent. The substantially transparent wrapper may exhibit shrinkage of around 0.2 percent.

In another embodiment, the present invention provides a mouthpiece for a smoking article, the mouthpiece comprising one or more segments and a substantially transparent wrapper circumscribing at least a portion of the one or more segments. The substantially transparent wrapper comprises a film and a moisture barrier coating applied directly or indirectly to at least one surface of the film. Preferably, a moisture barrier coating is applied to both surfaces of the film. The film may be a cellulose film. Preferably, the moisture barrier coating is applied directly to at least one surface of the film. However, in some embodiments, the moisture barrier may be applied indirectly to at least one surface of the film, by, for example, providing the moisture barrier coating on the outer surface of a sheet of material underlying the substantially transparent wrapper.

The contact angle of a water droplet with the moisture barrier coating is preferably at least about 80 degrees, more preferably at least about 85 degrees. In some embodiments, the contact angle is less than 150 degrees. Preferably, the contact angle is around 90 degrees.

In some embodiments, the moisture barrier coating is nitrocellulose lacquer.

In any of the embodiments described above, the mouthpiece may also include any of the additional features described above with reference to mouthpieces forming part of a smoking article in accordance with the invention.

The present invention also extends to the use of a substantially transparent wrapper and a paper wrapper in a smoking article, wherein a window is provided in the paper wrapper so that an underlying mouthpiece segment can be viewed through the window and the substantially transparent wrapper, and wherein the ratio of shrinkage of the substantially transparent wrapper to shrinkage of the paper wrapper at the time of manufacture of the smoking article is less than about 3.5 when subjected to 15 percent relative humidity at 42 degrees Celsius for 3 hours. Preferably, the ratio of shrinkage is less than about 3, more preferably less than about 2.5, even more preferably less than about 2, even more preferably less than about 1.5, even more preferably less than about 1. In some embodiments, the ratio of shrinkage is around 1.

Preferably, the shrinkage of the substantially transparent wrapper is less than about 0.85 percent, more preferably less than about 0.5 percent, and even more preferably less than about 0.2 percent. In one embodiment, the substantially transparent wrapper exhibits shrinkage of around 0.2 percent.

Preferably the nominal difference between the shrinkage of the substantially transparent wrapper and the shrinkage of the paper wrapper is less than about 0.5 percent, and even more preferably less than about 0.1 percent. For example, in one embodiment, the shrinkage of the substantially transparent wrapper may be about 0.6 percent and the shrinkage of the paper wrapper may be about 0.2 percent, giving a nominal difference of 0.4 percent.

The skilled person will appreciate that the features described previously with respect to the smoking article, such as the particular materials used to form the substantially transparent wrapper, are equally applicable to the use of a substantially transparent wrapper and a paper wrapper as described above.

The invention will now be further described, by way of example only, with reference to the accompanying drawings in which.

Figure 1:
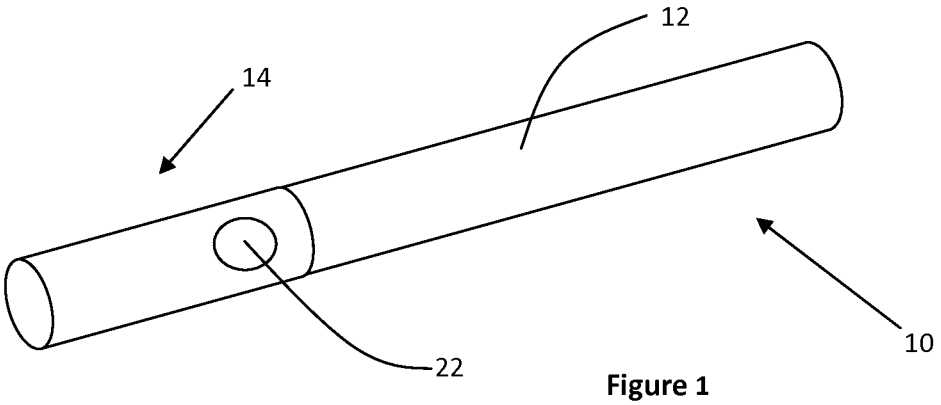
FIG. 1 shows a smoking article in accordance with the present invention.
Figure 2:
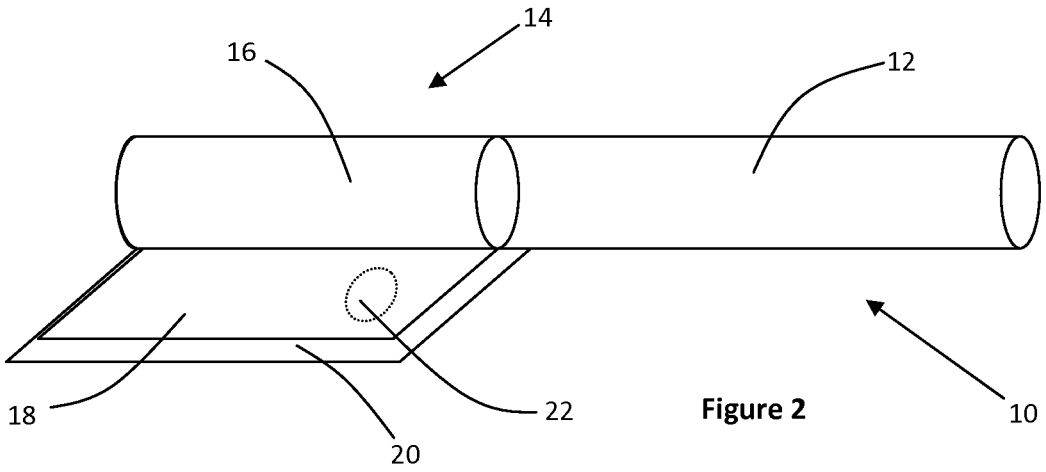
FIG. 2 shows the smoking article of FIG. 1 with the mouthpiece unwrapped.

The filter cigarette 10 shown in FIGS. 1 and 2 comprises a wrapped rod 12 of tobacco cut filler which is attached at one end to an axially aligned filter 14 comprising a single filter segment 16. The single filter segment 16 is formed of cellulose acetate tow which has been wrapped with a substantially transparent wrapper in the form of substantially transparent plug wrap 18. The filter segment 16 incorporates particles of a cellulosic material (not shown) impregnated with a liquid flavourant, which are dispersed within the cellulose acetate tow. The wrapped tobacco rod 12 and the filter 14 are joined by an outer wrapper 20 formed of standard tipping paper, which circumscribes the entire length of the filter 14 and an adjacent portion of the tobacco rod 12. The outer wrapper 20 is secured to the substantially transparent plug wrap 18 at adhesive bond points (not shown) spaced around the circumference of the filter 14.

The outer wrapper 20 comprises a circular cut-out portion 22 having a diameter of approximately 5 mm which is positioned approximately 5 mm from the rod end of the outer wrapper 20. The underlying substantially transparent plug wrap 18 is exposed through the cut-out portion 22 in the outer wrapper 20 and an area of the filter including the cellulosic granules is therefore visible through the cut-out portion 22.

The substantially transparent plug wrap 18 is formed from a cellulose diacetate film which exhibits shrinkage of approximately 0.2 percent when subjected to 15 percent humidity at 42 degrees Celsius for 3 hours. The low shrinkage minimises relative shrinkage between the substantially transparent plug wrap 18 and the outer wrapper 20, which typically exhibits shrinkage of approximately 0.26 percent under the same conditions. Accordingly, the outer wrapper 20 does not wrinkle when the cigarette 10 is subject to dry conditions, such as during storage.

Test Procedures

Contact Angle Test

Figure 3:
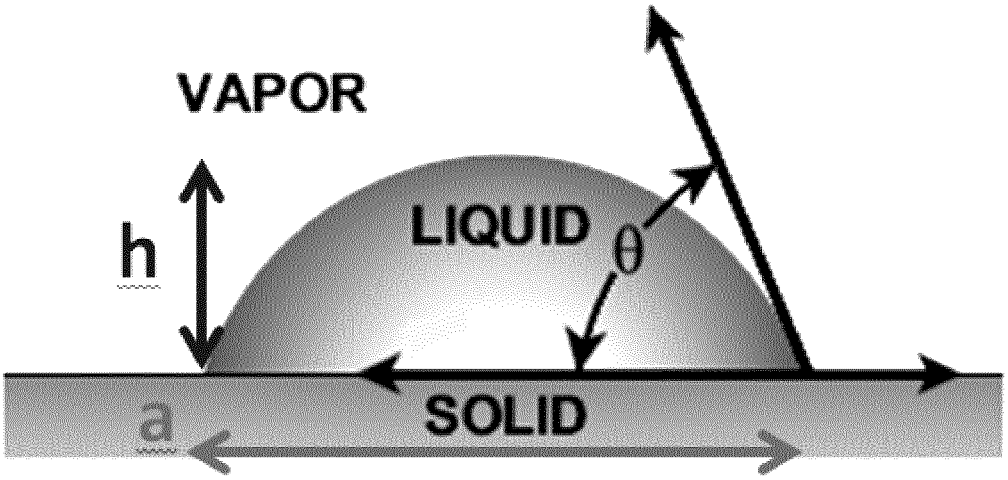
FIG. 3 shows a diagram illustrating how to calculate the contact angle of a droplet.

As shown in FIG. 3, the contact angle, theta (8), can be calculated by measuring the base of droplet (a) and the height of the droplet (h) to characterise the droplet shape. Using standard triangle geometry, the contact angle theta (8) can be calculated according to Equation 2 below:

$$\theta[\text{in degrees}]=2\times\arctan(2\times h/a) \quad (2)$$

A skilled person will have no difficulty in providing suitable means for making accurate measurements of the base of droplet (a) and the height of the droplet (h). For example, a high-resolution digital photograph can be taken of the droplet on the substrate and the base of droplet (a) and the height of the droplet (h) measured using appropriate computer software.

The base of droplet (a) and the height of the droplet (h) should be measured around 1 second after the droplet has been placed on the substrate. A suitable droplet volume is 4 microlitres and a suitable droplet composition is demineralised water.

Shrinkage Test 1

Preferably, the test is performed on samples of material obtained from the production facility prior to their use in forming a mouthpiece or a smoking article.

Ten sheets or strips of the material to be tested are measured along their longest dimension under normal atmospheric conditions (60 percent relative humidity at 22 degrees Celsius) and the lengths are recorded. A skilled person will readily understand that the lengths of the samples can be measured using any suitable length measuring device, such as a ruler. Any sample size can be used, although greater lengths will reduce the experimental error. As a compromise between reducing error and providing a practical sample size, sheets or strips having a length corresponding to A4 are appropriate for the test. The length of A4 is typically around 297 millimetres.

The sample sheet or strips are then stored under dry conditions (15 percent relative humidity at 42 degrees Celsius) for 3 hours. During the exposure to the dry conditions, the samples are placed on a shelf having a plurality of projections which support the samples in a raised position above the main body of the shelf. The projections help reduce the amount of shelf surface contacting the samples during exposure to the dry conditions, thereby ensuring a more uniform exposure.

After the 3 hour exposure to the dry conditions, the samples are then re-measured along the same dimension as was measured prior to exposure to the dry conditions and the new lengths recorded. The shrinkage for each sample can then be calculated using Equation 1 above. The shrinkage value for the material being tested is taken to be the number average of the shrinkage values obtained for the ten samples.

To accurately determine the shrinkage of a particular material, Shrinkage Test 1 should be used. However, as set out below, a second shrinkage test (Shrinkage Test 2) can be used to provide a general indication of the shrinkage levels of the materials when they have already been formed on a mouthpiece. The results of Shrinkage Test 2 may vary depending on the construction of the mouthpiece segment underlying the materials at the point of measurement. Accordingly, Shrinkage Test 2 should be used for no more than general guidance of whether the material exhibits certain shrinkage properties.

Shrinkage Test 2

The tests should be conducted on sample mouthpieces which are substantially the same as those used at the time of manufacture. Preferably, the test is performed on samples obtained from the production facility prior to their use in forming a smoking article. However, where such samples are not available, samples may be obtained from an already manufactured smoking article. In this case, the samples should be obtained prior to the mouthpieces being exposed to environmental conditions which may affect the test results, such as the dry conditions used in the test.

Three mouthpieces each comprising at least one segment and a substantially transparent wrapper are used for the test. The test can be used to indicate the presence of shrinkage of the substantially transparent wrapper.

Under normal atmospheric conditions (60 percent relative humidity at 22 degrees Celsius) the diameter of each mouthpiece is measured at three separate points along the length of the mouthpiece. The mouthpiece is marked (with a pen, for example) to provide a reference for each measurement point so that subsequent measurements can be made across the same diameter. A skilled person will have no difficulty in providing suitable means for making accurate diameter measurements. For example, a high-resolution digital photograph can be taken of the end of each mouthpiece and the diameter measured using appropriate computer software.

The sample mouthpieces are then stored under dry conditions (15 percent relative humidity at 42 degrees Celsius) for 3 hours. During the exposure to the dry conditions, the samples are placed on a shelf having a plurality of projections which support the sample in a raised position above the main body of the shelf. The projections help reduce the amount of shelf surface contacting the sample during exposure to the dry conditions, thereby ensuring a more uniform exposure.

After the 3 hour exposure to the dry conditions, the samples are then re-measured along the same diameters as measured previously, and the new diameters of the wrapper are recorded. The shrinkage of each wrapper for each sample can then be calculated using Equation 1 above, and the average shrinkage calculated to provide a shrinkage value for each wrapper material.

EXAMPLES

Example 1

Four different transparent films were tested using Shrinkage Test 1. The four sample films were: biaxially oriented polypropylene film, uncoated cellulose film, cellulose film with a 1.2 gram per square metre (gsm) nitrocellulose lacquer moisture barrier coating on one side, and cellulose diacetate film. The biaxially oriented polypropylene film sample and the uncoated cellulose film sample were each approximately A4 size. The cellulose film coated with nitrocellulose lacquer and the cellulose diacetate film sample were narrower strips which each had a length equivalent to A4 size. The tipping paper samples were narrower strips which had a length equivalent to A4 size. The results of the test are shown below:

| Material | Mean Shrinkage (%) [Calculated Using Equation 1] |
|---|---|
| Standard tipping paper (white appearance) | 0.26 |
| Standard tipping paper (cork appearance) | 0.21 |
| Uncoated cellulose film | 0.91 |
| Biaxially oriented polypropylene film | 0.3 |
| Cellulose film with nitrocellulose lacquer coating on one side | 0.68 |
| Cellulose diacetate film | 0.2 |

As can be seen from the table above, biaxially oriented polypropylene film, cellulose film coated on one side with nitrocellulose lacquer and cellulose diacetate film all show a significantly lower level of shrinkage compared to uncoated cellulose film, which has been used previously to form transparent plug wraps in smoking articles. The shrinkage of the biaxially oriented polypropylene film and the cellulose diacetate film is comparable to the shrinkage of the standard tipping papers. It is expected that providing a nitrocellulose lacquer on both sides of a cellulose film would further reduce shrinkage of the film compared to uncoated cellulose film.

Example 2

Based on the results from Example 1, a plurality of test mouthpieces were constructed using a single segment filter having a standard paper plug wrap.

A number of these test mouthpieces were overwrapped with a cellulose diacetate film (mouthpiece B), whilst another number of these mouthpieces were overwrapped with an uncoated cellulose film (mouthpiece A). The remainder of the test mouthpieces were left without any overwrapping material (mouthpiece C).

The shrinkage of the different mouthpieces was measured using Shrinkage Test 2 and the results are shown below:

| Mouthpiece | Mean Shrinkage (%) |
|---|---|
| A - Overwrapped with Cellulose film | 1.3 |
| B - Overwrapped with Cellulose diacetate film | 0.2 |
| C - Without any overwrapping material | 0.4 |

As a further general comparison, a number of cigarettes having a single segment filter with a standard paper plug wrap overwrapped by standard tipping paper (white appearance or cork appearance) were constructed. The shrinkage of the mouthpieces of these cigarettes was measured using Shrinkage Test 2 and the results are shown below:

| Mouthpiece | Mean Shrinkage (%) |
|---|---|
| Conventional paper plug wrap overwrapped with standard tipping paper (white appearance) | 0.24 |
| Conventional paper plug wrap overwrapped with standard tipping paper (cork appearance) | 0.24 |

It can be seen that using cellulose diacetate film as the plug wrap material in a mouthpiece results in a percentage shrinkage similar to that of a mouthpiece having conventional plug wrap paper overwrapped with standard tipping paper. On the other hand, it is apparent that using a cellulose film as the plug wrap material in a mouthpiece results in a percentage shrinkage significantly higher than that of a mouthpiece having conventional paper plug wrap overwrapped with standard tipping paper. The inventors have recognised that such significant relative shrinkage can cause wrinkling of the tipping paper when the mouthpiece is exposed to dry storage conditions.

Based on the results of Example 2, a number of test smoking articles were constructed using a filter with a cellulose diacetate film plug wrap circumscribed by standard tipping paper (smoking articles B). For comparison, a number of test smoking articles were constructed using a filter with an uncoated cellulose film plug wrap and standard tipping paper (smoking articles A).

Smoking articles A and B were left for 3 hours in 15 percent relative humidity at 42 degrees Celsius. After such exposure, wrinkling of the tipping paper in smoking articles A was visually perceivable to the naked eye, whereas no wrinkling of the tipping paper in smoking articles B was visually perceivable to the naked eye.

Therefore, to avoid undesirable wrinkling when using standard tipping paper (shrinkage of 0.26 percent), the inventors have found that the transparent plug wrap should have a shrinkage of about 0.85 percent or less. At these shrinkage values, the ratio of shrinkage of the transparent plug wrap to shrinkage of the tipping paper is 3.27 (that is, 0.85 divided by 0.26). Therefore, allowing for minor variations in the shrinkage of standard tipping paper, the ratio of shrinkage of the substantially transparent wrapper to the shrinkage of the paper wrapper in smoking articles manufactured according to the present invention should be less than about 3.5.

The invention claimed is:

1. A method of manufacturing a smoking article, the method comprising the steps of:

providing a mouthpiece comprising one or more segments and a substantially transparent wrapper circumscribing at least a portion of the one or more segments, the substantially transparent wrapper being formed from a polymeric film comprising cellulose diacetate;

providing an aerosol generating substrate in axial alignment with the mouthpiece;

providing a sheet of paper material comprising a window in the paper material, wherein the ratio of shrinkage of the substantially transparent wrapper to shrinkage of the paper material at the time of manufacture of the smoking article is less than 3.5 when subjected to 15 percent relative humidity at 42 degrees Celsius for 3 hours; and wrapping the sheet of paper material around at least a portion of the transparent wrapper so that an underlying mouthpiece segment can be viewed through the window and the substantially transparent wrapper.

2. A method according to claim 1, wherein the step of wrapping the sheet of paper material around at least a portion of the transparent wrapper includes wrapping the sheet of paper material around a portion of the aerosol generating substrate to secure the mouthpiece to the aerosol generating substrate.

3. A method according to claim 1, wherein the ratio of shrinkage is less than 3.

4. A method according to claim 1, wherein the step of providing a mouthpiece includes providing a mouthpiece with a transparent wrapper with a shrinkage of less than 0.85 percent.

5. A method according to claim 2, wherein the ratio of shrinkage is less than 3.

6. A method according to claim 2, wherein the step of providing a mouthpiece includes providing a mouthpiece with a transparent wrapper with a shrinkage of less than 0.85 percent.

7. A smoking article comprising:

a mouthpiece comprising one or more segments and a substantially transparent wrapper circumscribing at least a portion of the one or more segments, the substantially transparent wrapper being formed from a polymeric film comprising cellulose diacetate;

an aerosol generating substrate in axial alignment with the mouthpiece;

a paper wrapper circumscribing at least a portion of the mouthpiece and a portion of the aerosol generating substrate to secure the mouthpiece to the aerosol generating substrate; and a window in the paper wrapper so that an underlying mouthpiece segment can be viewed through the window and the substantially transparent wrapper;

wherein the ratio of shrinkage of the substantially transparent wrapper to shrinkage of the paper wrapper at the time of manufacture of the smoking article is less than 3.5 when subjected to 15 percent relative humidity at 42 degrees Celsius for 3 hours.

8. A smoking article according to claim 7, wherein the ratio of shrinkage is less than 3.

9. A smoking article according to claim 7, wherein the shrinkage of the substantially transparent wrapper at the time of manufacture of the smoking article is less than 0.85 percent.

10. A smoking article according to claim 8, wherein the shrinkage of the substantially transparent wrapper at the time of manufacture of the smoking article is less than 0.85 percent.

11. A method comprising:

assembling a substantially transparent wrapper and a paper wrapper about a mouthpiece segment of a smoking article, the substantially transparent wrapper being formed from a polymeric film comprising cellulose diacetate, wherein a window is provided in the paper wrapper so that the underlying mouthpiece segment can be viewed through the window and the substantially transparent wrapper, and wherein the ratio of shrinkage of the substantially transparent wrapper to shrinkage of the paper wrapper at the time of manufacture of the smoking article is less than 3.5 when subjected to 15 percent relative humidity at 42 degrees Celsius for 3 hours.

* * * * *